United States Patent [19]

Pfister et al.

[11] 3,961,954

[45] June 8, 1976

[54] ACID SENSITIZED CHARGE TRANSFER COMPLEXES AND CYCLIC ELECTROSTATOGRAPHIC IMAGING

[75] Inventors: Gustav R. Pfister, Webster; David J. Williams, Fairport; Martin A. Abkowitz, Webster, all of N.Y.

[73] Assignee: Xerox Corporation, Stamford, Conn.

[22] Filed: Dec. 27, 1972

[21] Appl. No.: 319,080

[52] U.S. Cl. ..... 96/1.6; 96/1 R; 96/1.4

[51] Int. Cl.[2] ..... G03G 5/09; G03G 13/14

[58] Field of Search ..... 96/1.5, 1.6, 1 R, 1.4

[56] References Cited

UNITED STATES PATENTS

| | | | |
|---|---|---|---|
| 3,704,122 | 11/1972 | Yamaguchi et al. | 96/1.5 |
| 3,736,134 | 5/1973 | Gosselink et al. | 96/1.5 |
| 3,740,218 | 6/1973 | Contois et al. | 96/1.5 |
| 3,764,315 | 10/1973 | Mort et al. | 96/1.5 |
| T870,006 | 1/1970 | Contois | 96/1.5 |

*Primary Examiner*—Edward C. Kimlin

*Attorney, Agent, or Firm*—James J. Ralabate; James Paul O'Sullivan; John H. Faro

[57] ABSTRACT

Electrostatographic imaging method employing an imaging member provided with a photoconductive imaging layer containing an organic photoconductive material, an activator capable of forming a charge transfer complex with said material and a protonic acid sensitizer. The acid sensitization of the charge transfer complex in this imaging layer dramatically enhances the photosensitivity of this photoconductive composition and yet avoids the undesirable memory effects generally experienced in such materials when a photoconductive layer of these materials is imaged in accord with the method of this invention.

5 Claims, 1 Drawing Figure

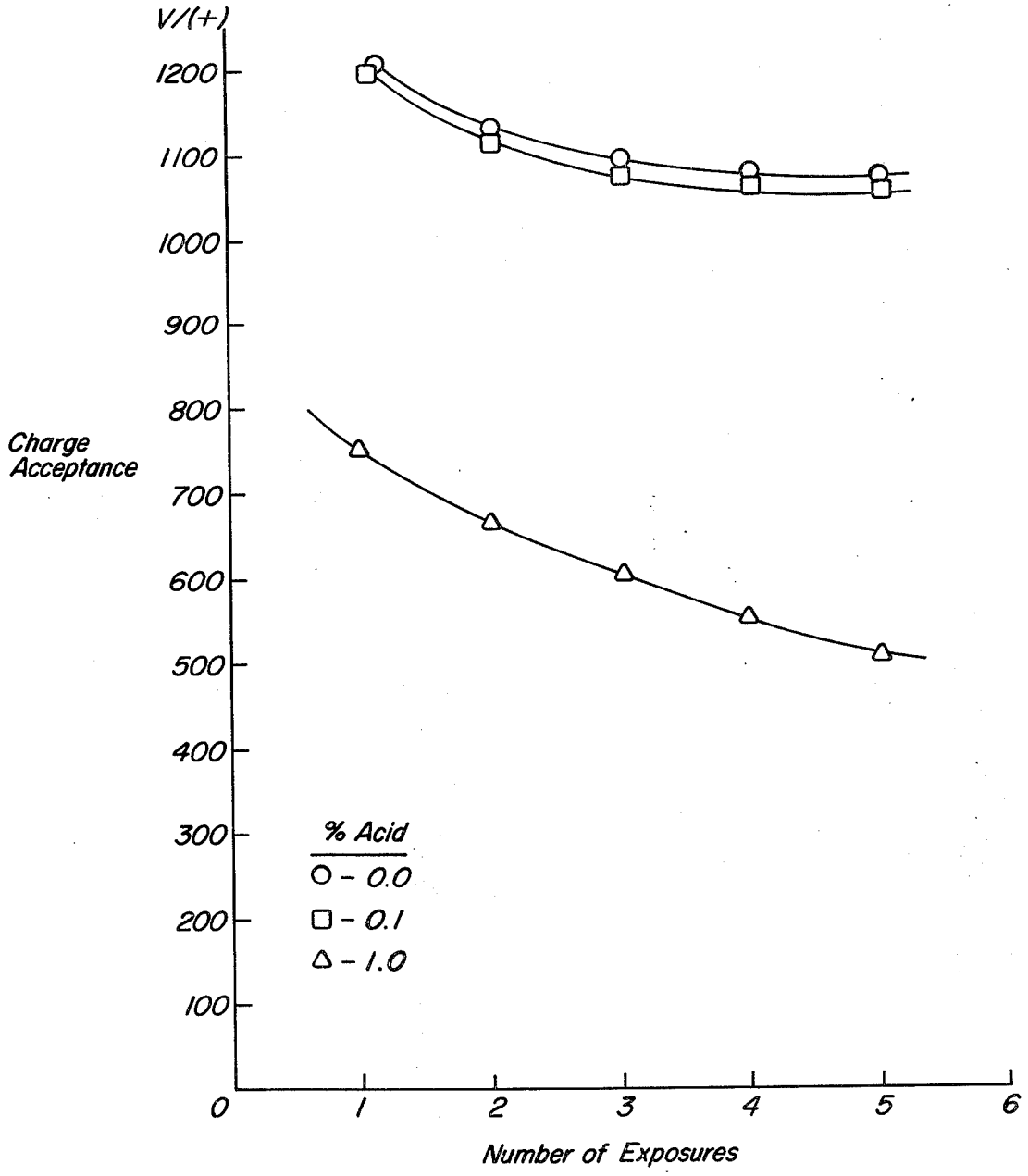
V/(+)
1200
1100
1000
900
800
700
600
500
400
300
200
100
0
Charge Acceptance
% Acid
○ - 0.0
□ - 0.1
△ - 1.0
1
2
3
4
5
6
Number of Exposures

ACID SENSITIZED CHARGE TRANSFER COMPLEXES AND CYCLIC ELECTROSTATOGRAPHIC IMAGING

BACKGROUND OF THE INVENTION

1. Field of the Invention

This invention relates to an electrostatographic imaging method and a photoconductive composition useful therein. More specifically, this invention provides a photoconductive composition wherein the non-persistent photocurrent is enhanced by sensitization with small concentrations of a protonic acid. Such composition is highly photosensitive and capable of rapid cycling without fatigue when imaged in accord with the method of this invention.

2. Description of the Prior Art

The formation and development of images on the imaging surfaces of photoconductive materials by electrostatic means is well known. The best known of the commercial processes, more commonly known as xerography, involves forming a latent electrostatic image on an imaging surface of an imaging member by first uniformly electrostatically charging this imaging surface and then exposing this electrostatically charged surface to a light and shadow image. The light struck areas of the imaging surface are thus rendered conductive and the electrostatic charge selectively dissipated in these irradiated areas. After the photoconductor is exposed, the latent electrostatic image on this image bearing surface is rendered visible by development with a finely divided colored electroscopic material, known in the art as "toner". This toner will be principally attracted to those areas on the image bearing surface which retain the electrostatic charge and thus render visible the latent image.

The developed image can then be read or permanently affixed to the photoconductor where the imaging surface is not to be reused. This latter practice is usually followed with respect to the binder type photoconductive films (e.g. ZnO) where the photoconductive imaging layer is also an integral part of the finished copy.

In so-called "plain paper" copying systems, the latent image can be developed on a reusable photoconductive surface or transferred to another surface, such as a sheet of paper, and thereafter developed. When the latent image is developed on a reusable photoconductive surface, it is subsequently transferred to another substrate and then permanently affixed thereto. Any one of a variety of well-known techniques can be used to permanently affix the toner image to the copy sheet, including overcoating with transparent films, and solvent or thermal fusion of the toner particles to the supportive substrate.

In the above "plain paper" copying system, the materials used in the photoconductive layer should preferably be capable of rapid switching from insulative to conductive to insulative state in order to permit cyclic use of the imaging surface. The failure of a material to return to its relatively insulative state prior to the succeeding charging sequence will result in an increase in the dark decay rate of the photoconductor. This phenomenon, commonly referred to in the art as fatigue, has in the past been avoided by the selection of photoconductive materials possessing rapid switching capacity. Typical of the materials suitable for use in such a rapidly cycling system include anthracene, sulfur, selenium and mixtures thereof (U.S. Pat. No. 2,297,691); selenium being preferred because of its superior photosensitivity.

In addition to anthracene, other organic photoconductive materials, most notably, poly (N-vinylcarbazole), have been the focus of increasing interest in electrophotography. Most organic photoconductive materials, including poly(N-vinylcarbazole), lack the inherent photosensitivity to be competitive with selenium. This need for the enhancement of the photoresponse characteristics of organic photoconductors thus led to the formulation of these organic materials with other compounds, commonly referred to as "activators". Poly (vinylcarbazoles), for example, when sensitized with 2,4,7,-trinitro-9-fluorenone exhibit good photoresponse and discharge characteristics and, (depending upon the polarity of the surface charge), low dark decay; U.S. Pat. No. 3,484,237. Other organic resins, traditionally considered nonphotoconductive can also be sensitized with certain activators, such as Lewis Acids, thus forming charge transfer complexes which are photoresponsive in the visible band of the spectrum U.S. Pat. Nos. 3,408,181; 3,408,182; 3,408,183; 3,408,184; 3,408,185; 3,408,186; 3,408,187; 3,408,188; 3,408,189; and 3,408,190. With respect to both the photoconductive and nonphotoconductive resins, the degree of sensitization is generally concentration dependant; the higher the loadings of activators, the greater the photoresponse.

The concentration of activator capable of formulation with the above materials, however, is finite; generally being limited to less than 10 weight percent of the composition. Ordinarily, the addition of high loadings of activator to many of the above materials will lead to impairment of mechanical and/or the photoconductive properties of the sensitized composition. In most instances, the excessive addition of activators to both the photoconductive and nonphotoconductive materials of the types disclosed in the above patents will result in crystallization of these activators, thus impairing the mechanical strength and other physical properties of the resultant photoconductive composition. Still yet other sensitizers, when present in relatively low concentrations can result in over sensitization of the composition in that the photocurrent generated upon exposure will persist long after illumination ceases, BUL. CHEM. SOC. of JAP. 39: 1660 – 1670 (1966). This phenomenon, commonly referred to in the art as "fatigue" prevents the further use of such materials for preparation of successive electrostatic reproductions until such persistent conductivity is dissipated in the previously illuminated areas of the photoconductor. This dissipation of persistant photocurrents generally takes an extended period of time and/or thermal erasure, thus making these oversensitized compositions generally unsatisfactory for rapid cycling electrostatographic imaging systems.

It is therefore the object of this invention to provide an acid sensitized photoconductive composition useful in a rapidly cycling electrostatographic imaging process.

Another object of this invention is to provide an imaging system wherein the photoconductive materials are highly photosensitive as a result of the enhancement of the non-persistent photocurrents.

Another of the objects of this invention is to provide an imaging system wherein enhancement of non-persistent photocurrents is the result of sensitization of a photoconductive charge transfer complex with an acid sensitizer.

SUMMARY OF THE INVENTION

The above and related objects are accomplished by providing a photoconductive composition comprising an organic photoconductive material, an activator capable of formation of a charge transfer complex with said material and from about 0.004 to about 0.1 weight percent of a protonic acid. The above composition when formed into an imaging layer and placed in operative association with the various other laminae of an imaging member, exhibits a dramatically enhanced nonpersistent photocurrent upon illumination. The above photoreceptor can be used in a rapid cycling imaging system without fatigue, provided the exposure interval is coordinated with the relative concentration of acid sensitizer in the imaging layer of the photoreceptor. For example, in the preferred embodiments of this invention, rapid cycling of the photoreceptor is achieved when the relative concentration of acid sensitizer contained in its imaging layer is in the range of from about 0.01 to about 0.1 weight percent and the flash exposure interval of the imaging process is less than about 0.1 second.

BRIEF DESCRIPTION OF DRAWING

FIG. 1 is a graphical representation of the effect that varying degrees of acid sensitization have upon the charge acceptance of the photoconductive composition.

DESCRIPTION OF THE INVENTION INCLUDING PREFERRED EMBODIMENTS

Organic photoconductive electron donor materials which can be used in preparation of the photoconductive compositions of the present invention include what can be termed "small molecule" photconductors dispersed in an inert cohesive matrix and any of a number of the polymeric photoconductive materials.

These so-called small molecule photoconductive materials include the following: oxadiazoles; e.g., 2,5-bis[4′-diethylaminophenyl]-1,3,4-oxadiazole, 2,5-bis-[4′-(n-propylamino) -2′-chlorophenyl-(1′)]-1,3,4-oxadiazole, 2,5-bis-[4′-N-ethyl-N-n-propylaminophenyl-(1′)]-1,3,4-oxadiazole, 2,5-bis-[4′-dimethylaminophenyl]-1,3,4-oxadiazole; triazoles, e.g., 1-methyl-2,5-bis-[4′-diethylaminophenyl]-1,3,4-triazole; imidazoles, e.g., 2-(4′-dimethylaminophenyl)-6-methoxy-benzimidazole; oxazoles, e.g. 2-(4′-chlorophenyl)-(phenanthreno-(9′-10′:4,5)-oxazole; thiazoles, e.g., 2-(4′-diethylaminophenyl)-benzthiazole; thiophenes, e.g. 2,3,5-triphenylthiophene; triazines, e.g. 3-(4′-aminophenyl) -5,6-dipyridyl-(2′)-1,2,4-triazine, 3-(4′-dimethylaminophenyl)-5,6-di(4′-phenoxyphenyl)-1,2,4-triazine; hydrazones, e.g. 4-dimethylaminobenzaldehyde isonicotinic acid hydrazone; styryl compounds, e.g. 2-(4′-dimethylaminostyryl)-6-methyl-4-pyridone, 2-(4′-dimethylaminostyryl)-5-(or 6)-aminobenzimidazole, bis (4-dimethylaminostyryl) ketone; azomethines, e.g. 4-dimethylaminobenzylidene-β-naphthylamine; acylhydrazones, e.g. 4-dimethylaminobenzylidenebenzhydrazine, 4-dimethylaminobenzylidene-4-hydroxybenzoic hydrazide, 4-dimethylaminobenzylidene-2-aminobenzoic hydrazide, 4-dimethylaminobenzylidene-4-methoxybenzoic hydrazide, 4-dimethylaminobenzylidene-iso-nicotinic hydrazide, 4-dimethylaminobenzylidene-2-methylbenzoic hydrazide; pyrazolines, e.g. 1,3,5-triphenylpyrazoline, 1,3-diphenyl-5-[4′-methoxy-phenyl]-pyrazoline, 1,3-diphenyl-5[4′-dimethylaminophenyl]pyrazoline; 1,5-diphenyl-3-styrylpyrazoline; 1-phenyl-3[4′-dimethylaminostyryl]-5-[4′-dimethylaminophenyl]-pyrazoline; imidazolones, e.g. 4-[4′-dimethylaminophenyl]-5-phenylimidazolone, 4-furfuryl-5-phenylimidazolone; imidazolethiones, e.g. 4-[4′-dimethylaminophenyl]-5-phenylimidazolethione, 3,4,5-tetraphenylimidazolethione; 1,3,5-triphenyl-4-[ 4′-dimethylaminophenyl-]imidazolethione; 1,3,4-triphenyl-5-furfurylimidazolethione; benzimidazoles, e.g. 2-[4′-dimethylaminophenyl]-benzimidazole, 1-methyl-2-[4′-dimethylaminophenyl]-benzimidazole, 1-phenyl-2-[4′-dimethylaminophenyl]benzimidazole; benzoxazoles, e.g. 2-[4′-dimethylaminophenyl]benzoxazole; and benzothiazoles, e.g. 2-[4′-dimethylaminophenyl]benzothiazole.

Materials which can be effectively used to provide the inert cohesive matrix for dispersion of the above small molecule photoconductors are polymers having fairly high dielectric strength and which are good electrically insulating film forming vehicles. Typical of such inert polymer matrices are: styrenebutadiene copolymers, silicone resins, styrene-alkyd resins; soya-alkyd resins; polyvinyl chloride; polyvinylidene chloride; vinylidene chloride-acrylonitrile copolymers; polyvinyl acetate; vinyl acetate-vinyl chloride copolymers; polyvinyl acetals, such as polyvinyl formal; polyacrylic and methacrylic esters, such as polymethyl methacrylate, poly-n-butyl methacrylate, polyisobutyl methacrylate; polystyrene, nitrated polystyrene; polymethylstyrene; isobutylene polymers; polyesters, such as polyethylene-alkaryloxyalkylene terephthalate; phenolformaldehyde resins; ketone resins, polyamide; and polycarbonates. Methods of making resins of this type have been described in the prior art, for example, styrene-alkyd resins can be prepared according to the method described in U.S. Pat. Nos. 2,361,019 and 2,258,423.

Typical polymeric photoconductive materials suitable for use in preparation of such photoconductive compositions include: poly-N-acrylylphenothiazine, poly-N-(β-acrylyloxyethyl)-phenothiazine, poly-N-(2-acrylyloxy propyl)-phenothiazine, polyallylcarbazole, poly-N-(2-acrylyloxy-2-methyl-N-ethyl) carbazole, poly-N-(2-p-vinylbenzoyl-ethyl)-carbazole, poly-N-propenylcarbazole, poly-N-vinyl-carbazole, poly-N-2-meth-acrylyloxypropyl carbazole, poly-N-acrylyl-carbazole, poly-(N-ethyl-3-vinylcarbazole), poly-4-vinyl-p-(-N-carbazyl)-toluene, poly (vinylanisal acetophenone), poly(vinylpyrene) and polyindenes. If desired, the monomers of the polymeric photoconductors can be copolymerized with each other or with other monomers, such as vinyl acetate, methylacrylate, vinylcinnamate, polystyrene, 2-vinylpyridine.

The photoresponsiveness of the above photoconductive materials are enhanced with respect to speed and spectral response by the addition thereto of any of a number of standard activators (electron acceptors) and, optionally, any one of a number of dyestuff sensitizers. The quantity of activator in the photoconductive compositions will vary depending upon the level of enhancement of conductivity desired and the effect such inclusions have on the physical properties of the composition. Generally, the amount of activator present in the photoconductive composition will range from about 0.1 to 50.0 weight percent based upon the weight of the photoconductive material, with 1–6 weight percent ordinarily being preferred. The quantity of dyestuff sensitizer that can be optionally added to the composition is similarly limited. Representative of activators which can be added to these compositions include nitrobenzene, m-dinitrobenzene; o-dinitrobenzene; p-dinitrobenzene; 1-nitro-naphthalene; 2-nitronapthalene; 2,5-dinitrophenapthrenequinone; 2,7-dinitrophenapthrenequinone; 3,6-dinitrophenapthrenequinone; 2,4 dinitrofluorene-$\Delta^{9,\alpha}$ -malononitrile; 2,5 dinitrofluorene-$\Delta^{\alpha}$ -malononitrile; 2,6 dinitrofluorene-$\Delta^{9,\alpha}$ -malononitrile; 2,7 dinitrofluorene-$\Delta^{9,\alpha}$ -malononitrile; 3,6 dinitrofluorene-$\Delta^{9,\alpha}$ -malononitrile; 2,4,7 trinitrofluorene-$\Delta^{9,\alpha}$ -malononitrile; 2,4,5,7 tetronitrofluorene-$\Delta^{9,\alpha}$ -malononitrile; 2,4-dinitrofluorenone; 2,5-dinitrofluorenone; 2,6-dinitrofluorenone; 2,7-dinitrofluorenone; and 2,4,7-trinitro-9-fluorenone. Especially preferred activators of the type described above are the nitroaromatics. Examples of dyestuff sensitizers suitable for incorportion in the photoconductive compositions of this invention are the triarylmethane dyestuffs such as Malachite Green, Brilliant Green, Victoria Blue B, Methyl Violet, Crystal Violet, Acid Violet 6B; xanthene dyestufs, namely rhodamines, such as Rhodamine B, Rhodamine 6G, Rhodamine G Extra, and Fast Acid Eosin G, as also phthaleins such as Eosin S, Eosin A, Erythrosin, Phloxin, Rose Bengal, and Fluorescein; thiazine dyestuffs such as Methylene Blue; acridine dyestuffs such as Acridine Yellow, Acridine Orange and Trypaflavine; and cyanine dyestuffs such as Pinacyanol, Cryptocyanine and Cyanine.

The protonic acids which can be used in enhancing the nonpersistent photocurrents of the compositions of this invention can be an proton donor having an aqueous dissociation constant of $10^{-4}$ and preferably greater. The upper concentration of acid in the composition is limited, since the addition of in excess of 0.1 percent by weight of such acids to the composition will also intensify the so called "memory effects" of the composition and thus render it unsuitable for a rapidly cycling imaging system. In the preferred embodiments of this invention, the acid concentration will generally be less than about 0.1 weight percent.

The photoconductive compositions of this invention can be prepared by dispersal of the above ingredients in their appropriate proportion in a suitable dispersal medium, forming a film of the dispersal on a conductive substrate and thereafter evaporation of the dispersant. The liquid dispersal can be applied to the conductive substrate by any of a number of standard coating techniques. Film thickness is controlled by either adjustment of the viscosity of the dispersal or by mechanical means or both. The films thus produced form a substantially uniform, continuous and adherent coating on the conductive substrate. Ordinarily, an average film thickness of about 5 to about 50 microns will provide the conductive substrate with an imaging layer of the requisite insulating and photodischarge characteristics to be suitable for imaging in a rapidly cycling electrostatographic imaging system.

Liquid dispersal media suitable for use in preparation of coatings of these photoconductive compositions include benzene; toluene; acetone; 2-butanone; chlorinated hydrocarbons, e.g., methylene chloride, ethylene ethers, e.g. tetrahydrofuran, and mixtures thereof.

The substrate material bearing the above photoconductive film can be virtually almost any conductive, self-supporting material. Examples of such supporting materials include conductive paper; metals, e.g., copper, aluminum, zinc, tin, iron and lead; polyethylene terephthalate having a thin overcoating of aluminum and copper; and NESA glass. Under certain conditions, injection of carriers from the substrate into the overlying film will occur. This can be prevented by the interfacing of an insulating barrier layer between the photoconductive film and the substrate. The resistivity of this interfacial barrier should be about 1 to 10 megohms per square. Materials which are suitable in providing such a charge injection barrier include any of the traditionally used metal oxides and insulating polymeric resins.

Once the organic photoconductive composition is operatively associated with a conductive substrate, the resultant imaging member is ready for use in an electrostatographic imaging system. When employed in a traditional xerographic type imaging system, the imaging member is substantially uniformly charged in the dark, selectively exposed to activating electromagnetic energy thereby selectively dissipating the charge on the surface of the imaging member subjected to said radiation thus forming a latent electrostatic image. This latent image can be developed directly on the imaging member or transferred to another surface where it is subsquently developed. When development of the latent image takes place on the surface of the imaging member, the toner image thus formed is usually transferred to another substrate, such as untreated paper, where it is thereafter permanently affixed by thermal or solvent fusion of the thermoplastic toner particles.

The Examples which follow further define, describe and illustrate preparation of a representative number of specific photoconductive compositions having the hereinbefore described physical properties. Imaging techniques and apparatus employed in such Examples, were not explicitly set forth, are presumed to be standard or as hereinbefore described.

EXAMPLES I – VII

A photoconductive composition of the present invention is prepared from poly (N-vinylcarbazole), 2,4,7-trinitro-9-fluorenone and trichloroacetic acid in the following manner: Ten grams of poly(N-vinylcarbazole) (molecular weight approximately 300,000) are reprecipitated twice from a mixture containing equal parts of tetrahydrofuran (THF) and methanol for removal of impurities. The polymer solids thus recovered are then dissolved in sufficient THF to form a solution containing 15 weight percent of the polymer. 2,4,7-trinitro-9-fluorenone is similarly purified by recrystallization from methanol and water. The 2,4,7-trinitro-9-fluorenone and trichloroacetic acid (anhydrous solid) are then added to the polymer solution in sufficient quantities such that the approximate weight ratio of the three components in solution is about 24 parts polymer: 5 parts activator: 0.30 parts acid (approximately 1 weight percent). Once thoroughly mixed, the resulting solution is cast on an aluminum plate 3 inches square with the assistance of a doctor blade having a wet gap setting of about 0.005 inches. The cured photoconductive film has an average thickness of about 10 microns.

Three additional films are prepared in the manner described above. The acid concentration of these films is varied so as to provide for comparison of the charge acceptance and the rate of photoinduced discharge at different acid concentration. The table which follows gives the rates of photoinduced discharge for photoconductive films having 0,0.01, 0.1 and 1.0 weight percent trichloroacetic acid. The surface potential of these films is monitored subsequent to positive corona charging using a shielded open loop wire connected to a Keithly $610_B$ electrometer. The films are illuminated through this loop. Changes in surface potential are recorded on a Tetronix 549 storage oscilloscope. The surface potential on these films is discharged using white light from a General Radio Strobotac flash equipped with an FX 6 U flash tube.

| Example No. | % Acid | Volts E(μ) (1) | dv/dt(volts/sec) (2) |
|---|---|---|---|
| I | 0 | 120 | $6.0 \times 10^5$ |
| II | .01 | 120 | $8.0 \times 10^5$ |
| III | .1 | 120 | $30.0 \times 10^5$ |
| IV | 0 | 75 | $6.0 \times 10^4$ |
| V | 1 | 75 | $30.0 \times 10^5$ |

(1) - field intensity;
(2) rate of photoinduced discharge with white light

Examples I and III are repeated except for the discharge of the surface potential with monochromatic light. The light source is substantially the same as that used above except for the projection of the light and shadow image through a 5000 A band pass filter. The intensity of this filtered strobe flash is about $2 \times 10^{10}$ photons/cm$^2$ sec.

| Example No. | % Acid | Volts E(μ) (1) | dv/dt(volts/sec) (2) |
|---|---|---|---|
| VI | 0 | 120 | $1.1 \times 10^5$ |
| VII | .1 | 120 | $3.1 \times 10^5$ |

(1) - field intensity;
(2) rate of photoinduced discharge with monochromatic light FIG. 1 provides graphic illustration of the charge acceptance of three of these films after repeated exposure and charging.

EXAMPLES VIII and IX

Two imaging members having a photoconductive layer of the composition of Example III and V respectively are prepared in accord with the previously described procedures of these Examples.

The imaging members are then separately corona charged in the dark to a positive potential of 1200 volts, their respective surface charge then being selectively dissipated by flash exposure projection of a full frame image onto their respective imaging surfaces, and the latent images thus formed developed with finely divided electroscopic toner particles. The light source is 150 Watt projection lamp and the shutter speed of the projection camera is set at 1/1000th of a second.

Subsequent to transfer of the developed image from the photoreceptor, the imaging layers are cleaned and any residual surface charge neutralized. The charging, exposure and development cycles are then repeated using a different image. The imaging member having the photoconductive composition of Example III yields an image comparable in quality to the prior reproduction, whereas the subsequent image prepared on the member provided with an imaging layer of the composition of Example V appears to be incompletely developed. This incomplete development is attributed to the presence of persistent photocurrents in the imaging layer and thus the inability of the photoreceptor to retain the surface charge in these persistently conductive areas.

The imaging member demonstrating good cyclic capability is then charged, imaged and developed as hereinbefore described, except that the duration of exposure is varied. The table which follows attempts to correlate the duration of the exposure interval and the cycling capability of the imaging member.

| EXPOSURE INTERVAL IN SECONDS | COPY QUALITY AFTER 2nd EXPOSURE |
|---|---|
| 0.025 | Good |
| 0.050 | Good |
| 0.075 | Good |
| 0.100 | Good, some minor print deletions |
| 0.200 | Fair, moderate print deletions |

From the data in the above Examples, it is apparent that it is necessary to coordinate the exposure interval and the relative acid concentration of the imaging layer in order to avoid the generation of persistent photocurrents which manifest themselves in poor cycling capability of the photoreceptor. Ideally, the extent of exposure of the imaging layer of the photoconductive element should be sufficient to generate a non-persistent photocurrent of the photoconductive composition without any substantial corresponding generation of persistent photocurrents in the imaging layer; and yet sufficiently discharge the surface charge on the imaging layer to produce the adequate contrast potential required in the generation of a latent image capable of further development.

EXAMPLE X – XIX

The following compositions are prepared in accordance with the procedures of Example I – VII. The relative weight ratio of ingredients in each composition is the same as in Example III.

| Ex. No. | Polymer | Activator | Acid |
|---|---|---|---|
| X | poly(N-vinylcarbazole) | o-dinitrobenzene | maleic acid |
| XI | poly(N-vinylcarbazole) | TNF | maleic acid |
| XII | poly(N-ethyl-3-vinyl-carbazole) | o-dinitrobenzene | trichloroacetic acid |
| XIII | poly(N-ethyl-3-vinyl-carbazole) | TNF | trichloroacetic acid |
| XIV | poly(N-ethyl-3-vinyl- | o-dinitrobenzene | maleic acid |

-continued

| Ex. No. | Polymer | Activator | Acid |
|---|---|---|---|
| | carbazole) | | |
| XV | poly(N-ethyl-3-vinyl-carbazole) | TNF | maleic acid |
| XVI | poly(vinylpyrene) | o-dinitrobenzene | trichloroacetic acid |
| XVII | poly(vinylpyrene) | TNF | trichloroacetic acid |
| XVIII | poly(vinylpyrene) | o-dinitrobenzene | maleic acid |
| XIX | poly(vinylpyrene) | TNF | maleic acid |

All of the photoconductive films prepared from the above compositions are useful in a rapidly cycling xerographic imaging system.

What is claimed is:

1. A cyclic electrostatographic imaging method comprising:

a. providing an imaging member having a photoconductive imaging layer containing an organic photoconductive material, an activator capable of formation of a charge transfer complex with said material and from about 0.01 to less than about 0.1 weight percent of an organic protonic acid having an aqueous dissociation constant of $10^{-4}$ or greater;

b. forming a latent electrostatic image on the surface of said imaging layer by first charging said surface followed by exposing said surface to a light and shadow image, the extent of exposure being sufficient to generate nonpersistent photocurrents in the irradiated areas of said layer without any substantial corresponding generation of persistent photocurrents in these same irradiated areas;

c. rendering said latent image visible by development with finely divided toner particles;

d. removing at least a portion of at least any residual developed image from said imaging surface; and e. repeating steps a-d in sequence at least one additional time.

2. The imaging method of claim 1, wherein the protonic acid is trichloracetic acid.

3. The imaging method of claim 1, wherein the photoconductive material is a carbazole containing polymer.

4. The imaging method of claim 1, wherein the activator is 2,4,7-trinitro-9-fluorenone.

5. The imaging method of claim 1, wherein the latent image is formed by flash exposure projection of a full frame light and shadow image onto the changed surface of the imaging layer.

* * * * *